US009627740B2

(12) United States Patent
Katipally et al.

(10) Patent No.: US 9,627,740 B2
(45) Date of Patent: Apr. 18, 2017

(54) RF NOTCH FILTERS AND RELATED METHODS

(71) Applicant: Radio Frequency Systems,Inc., Meriden, CT (US)

(72) Inventors: Raja Reddy Katipally, Chesire, CT (US); Jari Taskila, Meriden, CT (US)

(73) Assignee: Alcatel-Lucent Shanghai Bell Co., Ltd, Shanghai (CN)

( * ) Notice: Subject to any disclaimer, the term of this patent is extended or adjusted under 35 U.S.C. 154(b) by 0 days.

(21) Appl. No.: 14/608,804

(22) Filed: Jan. 29, 2015

(65) Prior Publication Data

US 2016/0226125 A1 Aug. 4, 2016

(51) Int. Cl.

| | |
|---|---|
| ***H01P 1/208*** | (2006.01) |
| ***H01P 7/04*** | (2006.01) |
| ***H01P 11/00*** | (2006.01) |

(52) U.S. Cl.
CPC ..... *H01P 11/007* (2013.01); *H01P 1/208* (2013.01); *H01P 7/04* (2013.01)

(58) Field of Classification Search
CPC ..... H01P 1/205; H01P 1/207; H01P 11/007; H01P 7/04
USPC ..... 333/222, 202–212
See application file for complete search history.

(56) References Cited

U.S. PATENT DOCUMENTS

| | | | | |
|---|---|---|---|---|
| 5,777,534 | A * | 7/1998 | Harrison | H01P 1/2084 333/202 |
| 5,949,309 | A * | 9/1999 | Correa | H01P 1/2084 333/202 |
| 7,482,897 | B2 * | 1/2009 | Puoskari | H01P 1/209 333/206 |
| 2002/0145490 | A1 * | 10/2002 | Sauder | H01P 1/2053 333/202 |
| 2002/0150066 | A1 * | 10/2002 | Schilling | H04B 1/707 370/335 |
| 2004/0041661 | A1 * | 3/2004 | Yamakawa | H01P 1/2084 333/134 |
| 2012/0242425 | A1 * | 9/2012 | Burke | C23C 18/1653 333/202 |

* cited by examiner

*Primary Examiner* — Stephen E Jones
*Assistant Examiner* — Rakesh Patel
(74) *Attorney, Agent, or Firm* — The Capitol Patent & Trademark Law Firm, PLLC

(57) ABSTRACT

A radio-frequency (RF), base station notch filter includes an integral, conductive RF notch filter structure having one or more notch filter elements, where the notch filter elements may be circular in shape. The integral notch filter reduces insertion losses and passive intermodulation distortion.

17 Claims, 3 Drawing Sheets

RF NOTCH FILTERS AND RELATED METHODS

INTRODUCTION

Existing wireless base stations utilize a combination of a main transmission line and individual, cavity coupling wires to form a desired radio-frequency (RF) "notch" filter that allows one or more desired frequencies to be transmitted by the base station. However, this design has its disadvantages. For example, existing designs are subject to tuning time errors, insertion losses and distortion caused by the effects of passive intermodulation. Such effects can degrade the performance of the base station.

It is, therefore, desirable to provide RF notch filters and related methods that avoid the disadvantages of existing designs.

SUMMARY

Exemplary embodiments of a RF notch filter and related methods for forming such a filter are provided.

According to one embodiment, an inventive RF notch filter may comprise an integral, conductive RF notch filter structure comprising one or more notch filter elements, each element operable to be coupled to a cavity resonator. The inventive RF notch filters may be operable to output or filter (i.e., pass or block) (collectively referred to as "operate over") a frequency in the range of 100 MHz to 5 GHz. Additional components may be a part of such an inventive notch filter. For example, an RF notch filter may additionally include (and typically does include): one or more cavity resonators, a filter housing and one or more connectors.

In embodiments of the invention, each of the one or more notch filter elements may be configured as a circular element, where the diameter of each notch filter element is between 0.4 to 2 inches. It should be understood that depending on the usable cavity volume, and the coupling strength required for a given desired performance, the diameter of an element may vary or change.

Inventive RF notch filters may include integral, conductive RF notch filter structures that are either substantially copper structures, substantially brass structures or some combination of the two types of conductive, material structures.

In embodiments of the invention, the inventive integral, conductive RF notch filter structures may be formed as a printed circuit, stamped circuit or machined circuit.

In addition to structures, the present invention provides methods for forming and using such inventive structures. In one embodiment, a method for forming an RF notch filter may comprise forming an integral, conductive RF notch filter structure comprising one or more notch filter elements to operate over a range of RF frequencies. For example, each formed notch filter structure may operate over a frequency range of 100 MHz to 5 GHz.

Yet further, the method may further comprise forming each of the one or more notch filter elements as a circular element having a diameter of 0.4 to 2 inches. Still further, a part of the process may include attaching one or more connectors to a notch filter structure.

Inventive integral, conductive RF notch filter structures may be formed using a process selected from the group consisting of a printed circuit process, a stamped circuit process or a machined circuit process, to name a few exemplary formation processes.

After formation, the method may include installing an inventive RF notch filter structure in a base station.

Additional features will be apparent from the following detailed description and appended drawings.

DETAILED DESCRIPTION, WITH EXAMPLES

Figure 1:
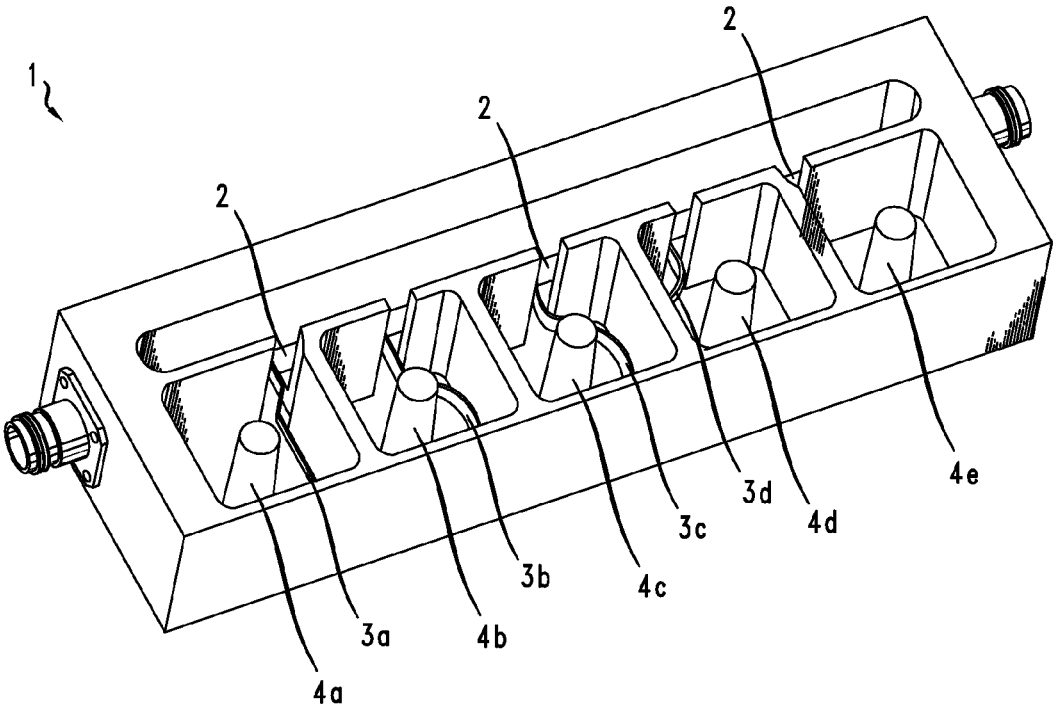
FIG. 1 (PRIOR ART)
FIG. 1 depicts the design of an existing RF notch filter.

Exemplary embodiments of a RF notch filter and related methods for forming such a filter are described herein and are shown by way of example in the drawings. Throughout the following description and drawings, like reference numbers/characters refer to like elements.

It should be understood that, although specific exemplary embodiments are discussed herein, there is no intent to limit the scope of present invention to such embodiments. To the contrary, it should be understood that the exemplary embodiments discussed herein are for illustrative purposes, and that modified and alternative embodiments may be implemented without departing from the scope of the present invention.

It should also be noted that one or more exemplary embodiments may be described as a process or method. Although a process/method may be described as sequential, it should be understood that such a process/method may be performed in parallel, concurrently or simultaneously. In addition, the order of each step within a process/method may be re-arranged. A process/method may be terminated when completed, and may also include additional steps not included in a description of the process/method.

As used herein, the term "and/or" includes any and all combinations of one or more of the associated listed items. As used herein, the singular forms "a," "an" and "the" are intended to include the plural form, unless the context and/or common sense indicates otherwise.

As used herein, the term "embodiment" refers to an embodiment of the present invention.

FIG. 1 depicts the design of an existing RF notch filter 1. As shown the filter 1 includes a combination of a main transmission line 2 and a plurality of coupling wires 3*a* to 3*d*. Each of the individual wires 3*a*-3*d* may be connected to the main transmission line 2 on one end and to a resonator cavity 4*a* to 4*d* on the opposite end. In general, the connection of each wire 3*a* to 3*d* to the main line 2 forms a 90° angle between each wire 3*a* to 3*d* and the main line 2. Coupling of each wire 3*a* to 3*d* to the main line 2 and to one of the cavities 4*a* through 4*d* may be via a solid, direct current (DC), grounded connection while the coupling of each wire 3*a* to 3*d* to a resonator 4*a* to 4*d* is via a capacitive or inductive coupling. The length of the main line 2 (and wires 3*a* to 3*d*) may be shortened or lengthened to form a desired RF notch filter to allow a desired frequency or range of frequencies to be passed (i.e., transmitted) or blocked (collectively "filtered") due to the fact that the length of the main line affects the frequency that is passed or blocked. It should be understood that while a wire coupling cavity 4*e* to the main line 2 is not shown in FIG. 1 it exists nonetheless. For the sake of efficiency other elements making up the base station, such as antennas, are not shown in FIG. 1.

As mentioned before, the design of the existing RF notch filter 1 in FIG. 1 has its disadvantages. To overcome or reduce the disadvantages of the design exemplified by filter 1, the inventors provide designs exemplified by the filters depicted in FIGS. 2 through 4.

Figure 2:
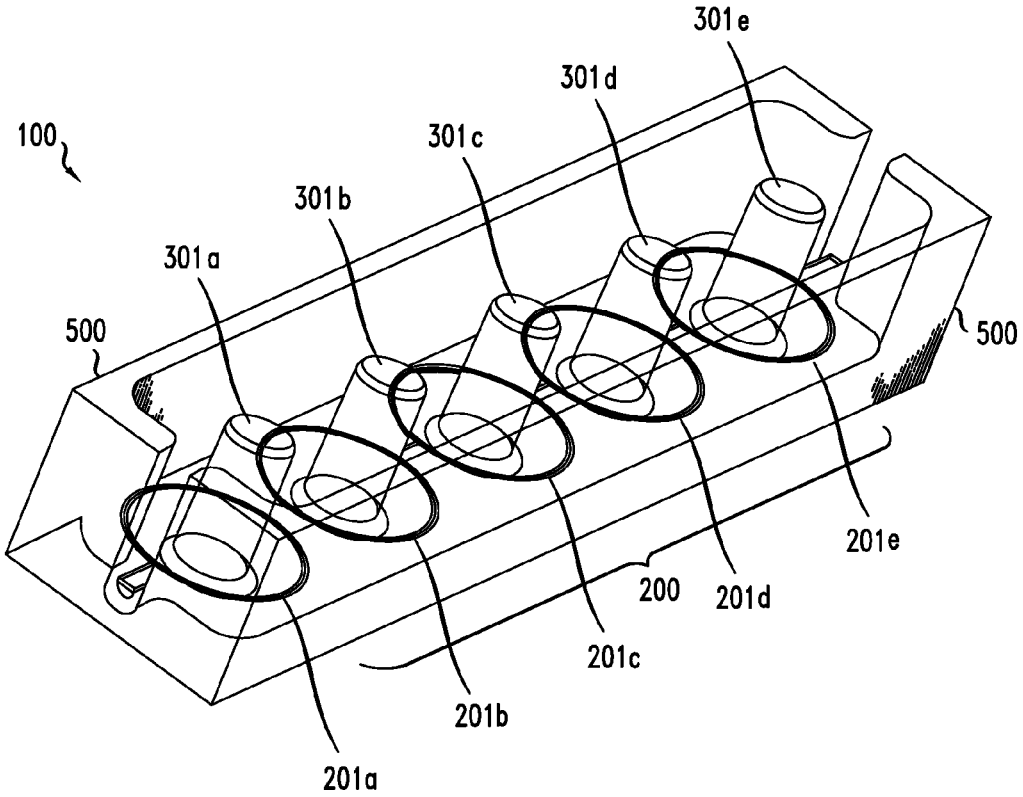
FIG. 2 depicts a RF notch filter according to an embodiment of the present invention.

Referring to FIG. 2, there is shown a RF notch filter 100 according to one embodiment. As shown, the filter 100 may comprise an integral, conductive RF notch filter structure 200 comprising one or more notch filter elements 201*a* to 201*e*. In accordance with one embodiment, each element 201*a* to 201*e* may be operable to be capacitively or inductively coupled to a cavity resonator 301*a* to 301*e*. As shown in FIG. 2, in one embodiment each of the elements 201*a* to 201*e* may comprise a coupling loop.

While the embodiment depicted in FIG. 2 shows five (5) elements 201*a* to 201*e*, it should be understood that this is for illustrative purposes only. In alternative embodiments the number of elements may be less than, or greater than five. In an embodiment, the filter 100 may be part of an RF base station, and may be operable to operate over a frequency range of 100 MHz to 5 GHz, though it should be understood that other ranges are possible and within the scope of the present invention.

The RF notch filter 100 may additional comprise one or more cavity resonators 301*a* to 301*e* ("cavity" or "cavities" for short). It should be understood that the physical structure of the cavities shown in FIGS. 1-4 is for illustration purposes only, and that depending on the frequency or range of frequencies selected, the physical structure may change (e.g., a "top hat" may be added). Further, the filter 100 may comprise a housing 500 for protecting the structure 200, and cavities 301*a* to 301*e*. For ease of explanation only three sides of the housing 500 are shown (i.e., the top side or "tuning cover" is not shown), though it should be understood that the housing typically has four sides (i.e., a tuning cover is added). Though the embodiment in FIG. 2 depicts notch filter elements arranged in a single, integral line on a single surface of the housing 500, it should be understood that this is for example only. In additional embodiments, a filter may include elements arranged in one or more multiple rows and columns on a single surface, or on multiple surfaces of a housing (e.g., top and bottom, front and back).

As indicated above, each of the one or more notch filter elements 201*a* through 201*e* may be configured as a coupling loop that comprises a substantially circular element having a diameter of 0.4 to 2 inches, to give just an exemplary range of diameters for example. It should be understood that depending on the usable cavity volume, and the coupling strength required for a given desired performance, the diameter of the elements 201*a* to 201*e* may vary or change. In accordance with embodiments of the invention, by changing the diameter of the element 201*a* through 201*e*, the coupling of an element 201*a* to 201*e* with a cavity 301*a* to 301*e* may increase or decrease. For example, smaller diameters typically result in increased (i.e., higher) coupling of an element to a cavity (e.g., coupling of a 100 MHz signal) while larger diameters typically result in decreased (i.e., weaker) coupling of an element to a cavity (e.g., coupling of a 1 MHz signal).

In embodiments of the invention, the integral, conductive RF notch filter structure 200 may comprise a printed circuit, stamped circuit or machined circuit, for example, formed from an associated process. The integral structure may be formed from a conductive material or composition, such as a substantially copper material or composition or a substantially brass material or composition, for example. Accordingly, the structure may comprise a substantially copper structure, a substantially brass structure, some combination of the two types of materials or another type of conductive material.

Figure 3:
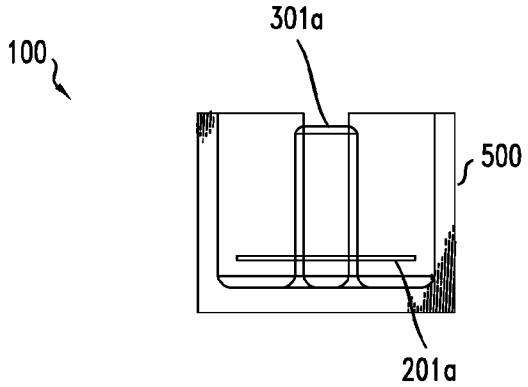
FIG. 3 depicts another view of a RF notch filter according to an embodiment of the present invention.

FIG. 3 depicts a side or cross-sectional view of the exemplary RF notch filter 100 shown in FIG. 2 according to an embodiment of the present invention.

Figure 4:
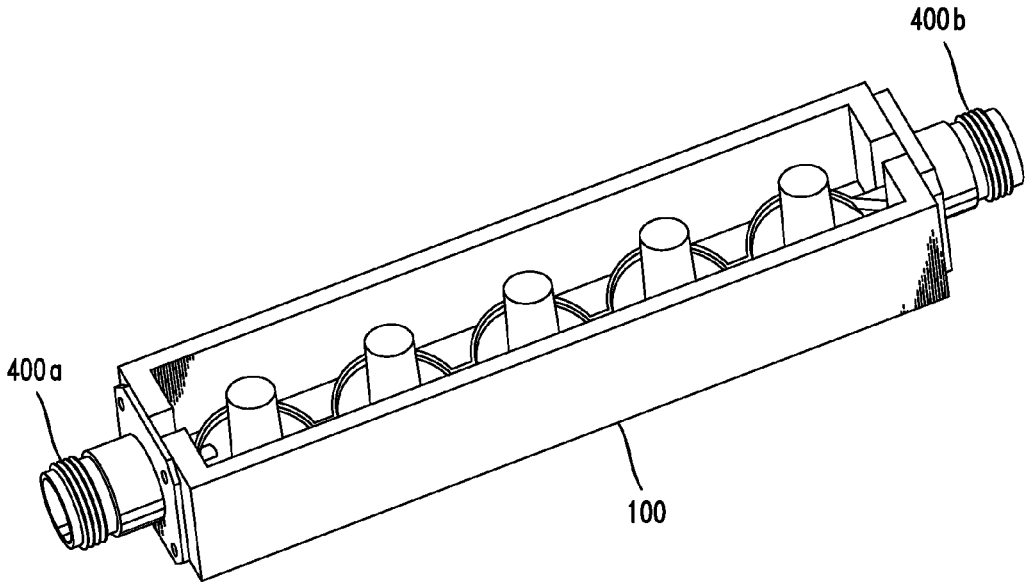
FIG. 4 depicts yet another view of a RF notch filter according to an embodiment of the present invention.

FIG. 4 depicts yet another view of the filter 100 that includes connectors 400*a* and 400*b*. Each of the connectors may be used to electrically, mechanically or otherwise connect the filter 100 to other parts used in an RF base station, such as to another RF notch filter or to an electrical circuit, for example. In the embodiment shown in FIG. 4 the connectors 400*a* and 400*b* comprise N-type connectors. It should be understood, however, that many different types of connectors other than N-type may be used. That is, depending on the design or type of component or transmission medium (e.g., cable) the filter 100 is connected to, the design and type of the connectors 400*a* and 400*b* may vary or change. For example, when the filter 100 is to be connected to a coaxial cable one or both of the connectors 400*a* and 400*b* may comprise coaxial connectors. Other types of connectors, such as exposed tabs for PCB soldering and direct cable soldered connectors may be used, for example. While the embodiment depicted in FIG. 4 shows two (2) connectors 400*a* and 400*b*, it should be understood that this is for illustrative purposes only. In alternative embodiments the number of connectors may be less than, or greater than two.

In addition to the structures described above and herein, the present invention also provides for related methods for forming and utilizing inventive notch filters. For example, in one embodiment a method for forming an RF notch filter may comprise forming an integral, conductive RF notch filter structure comprising one or more notch filter elements to filter a range of RF frequencies. Such a method may include forming each of the one or more notch filter elements as a circular element. In addition the method may include forming a notch filter element as a circular element having a diameter of 0.4 to 2 inches.

Integral, conductive RF notch filter structures may be formed using one or more processes, such as a process selected from the group consisting of a printed circuit process, a stamped circuit process or a machined circuit process, to name some examples.

After a notch filter structure is formed, it may be installed, or otherwise made a part of a base station or apparatus used in such a base station. As an additional step in a method for forming the inventive notch filter structures or installing them, the method may further include attaching one or more connectors to the notch filter structure.

In one embodiment, a formed or installed notch filter structure may operate over a frequency range of 100 MHz to 5 GHz.

While exemplary embodiments have been shown and described herein, it should be understood that variations of the disclosed embodiments may be made without departing from the spirit and scope of the claims that follow.

We claim:

1. A radio-frequency (RF) notch filter comprising:

a plurality of cavity resonators; and a plurality of circular notch filter elements, each of said circular notch filter elements encircling one of the cavity resonators, and is non-conductively coupled to a corresponding one of the cavity resonators.

2. The RF notch filter as in claim 1 further comprising a filter housing, wherein the RF notch filter is disposed within the housing.

3. The RF notch filter as in claim 1 wherein one or more of the notch filter elements comprises a closed loop notch filter element.

4. The RF notch filter as in claim 1, wherein the RF notch filter is operable to operate over a frequency range of 100 MHz to 5 GHz.

5. The RF notch filter as in claim 1 wherein each of the circular elements has a diameter of 0.4 to 2 inches.

6. The RF notch filter as in claim 1, wherein the RF notch filter is a part of a base station.

7. The RF notch filter as in claim 1 wherein the RF notch filter comprises a stamped circuit, machined circuit or printed circuit.

8. The RF notch filter as in claim 1 wherein the RF notch filter comprises a substantially brass structure.

9. The RF notch filter as in claim 1 further comprising one or more connectors forming input and outputs for the RF notch filter.

10. The RF notch filter as in claim 1 wherein the RF notch filter comprises a substantially copper structure.

11. A method for forming a radio-frequency (RF) notch filter comprising:

forming an integral, conductive RF notch filter comprising a plurality of cavity resonators, and a plurality of circular notch filter elements, each of said circular notch filter elements encircling one of the cavity resonators, and non-conductively coupled to a corresponding one of the cavity resonators.

12. The method as in claim 11 further comprising forming one or more of the RF notch filter elements as a closed loop notch filter element.

13. The method as in claim 11, wherein the notch filter operates over a frequency range of 100 MHz to 5 GHz.

14. The method as in claim 11 further comprising configuring inputs and outputs by attaching one or more connectors to the notch filter.

15. The method as in claim 11 further comprising installing the RF notch filter in a base station.

16. The method as in claim 11 further comprising forming each of the circular elements with a diameter of 0.4 to 2 inches.

17. The method as in claim 11 further comprising forming the RF notch filter using a process selected from the group consisting of a printed circuit process, a stamped circuit process or a machined circuit process.

* * * * *